US006189600B1

(12) United States Patent
Taniguchi et al.

(10) Patent No.: US 6,189,600 B1
(45) Date of Patent: Feb. 20, 2001

(54) METHOD AND APPARATUS FOR PRODUCTION OF AMORPHOUS ALLOY ARTICLE FORMED BY METAL MOLD CASTING UNDER PRESSURE

(75) Inventors: Takeshi Taniguchi; Junichi Nagahora, both of Sendai (JP)

(73) Assignee: YKK Corporation, Tokyo (JP)

( * ) Notice: Under 35 U.S.C. 154(b), the term of this patent shall be extended for 0 days.

(21) Appl. No.: 09/413,540

(22) Filed: Oct. 6, 1999

Related U.S. Application Data

(62) Division of application No. 09/066,052, filed on Apr. 27, 1998, now Pat. No. 6,044,893.

(30) Foreign Application Priority Data

Jan. 1, 1997 (JP) ..... 9-126229

(51) Int. Cl.[7] ..... B22D 17/12
(52) U.S. Cl. ..... 164/262; 164/312
(58) Field of Search ..... 164/312, 113, 164/262, 70.1, 133

(56) References Cited

U.S. PATENT DOCUMENTS 4,842,038 * 6/1989 Fujino et al. ..... 164/312

FOREIGN PATENT DOCUMENTS 55-73453 * 6/1980 (JP) ..... 164/312
57-47568 * 3/1982 (JP) ..... 164/133
1-321062 * 12/1989 (JP) ..... 164/262

* cited by examiner

*Primary Examiner*—Kuang Y. Lin
(74) *Attorney, Agent, or Firm*—Finnegan, Henderson, Farabow, Garrett, & Dunner, L.L.P.

(57) ABSTRACT

An apparatus for producing a formed article of amorphous alloy by a simple process are disclosed. A molding apparatus comprises a forced cooling casting mold which is provided with a sprue and at least one molding cavity communicating with the sprue and further with a cutting member disposed in the casting mold movably in the direction of the sprue, a melting vessel movable in the direction of the sprue, and a molten metal transferring member disposed slidably in the melting vessel or the molding cavity of the casting mold. A formed article of amorphous alloy is obtained by melting an alloying material in the vessel, forcibly transferring the resultant molten alloy into the molding cavity by means of the molten metal transferring member and meanwhile exerting pressure on the molten alloy, rapidly cooling and solidifying the molten alloy in the casting mold thereby conferring amorphousness on the alloy and meanwhile gradually cooling and solidifying the molten alloy in the part of the sprue of the casting mold thereby crystallizing the alloy in that part, cutting the part which has been embrittled by the crystallization by means of the cutting member, and thereafter separating the melting vessel from the casting mold.

15 Claims, 10 Drawing Sheets

METHOD AND APPARATUS FOR PRODUCTION OF AMORPHOUS ALLOY ARTICLE FORMED BY METAL MOLD CASTING UNDER PRESSURE

This application is a divisional of application Ser. No. 09/066,052, filed Apr. 27, 1998, now U.S. Pat. No. 6,044,893.

BACKGROUND OF THE INVENTION

1. Field of the Invention

This invention relates to a method and apparatus for the production of an amorphous alloy article formed by metal mold casting under pressure.

2. Description of the Prior Art

The single roll method, twin roll method, gas atomizing method, etc. are adopted for the production of amorphous alloy because this production generally necessitates a high cooling rate falling in the approximate range of $10^4$–$10^6$ K/s. The products obtained by such methods are limited in shape to ribbons of foil, fine wires, and particles. This fact constitutes itself a factor for rigidly limiting the field of applications found for amorphous alloy.

Feasibility studies are under way, therefore, regarding a method of producing a formed article of amorphous alloy with a large thickness by shaping an amorphous alloy prepared in the form of powder by some means such as extrusion or impact compression at a temperature not exceeding the crystallization temperature of the alloy. The production by this method, however, requires complicated steps such as sieving the powder, degasing the prepared powder, and preforming the powder prior to the main forming and calls for expensive facilities as well. This method, therefore, is at a disadvantage in inevitably furnishing only expensive products.

As a means for producing a formed article of amorphous alloy by a simple process unlike such powder molding process, published Japanese Patent Application, KOKAI (Early Publication) No. 8-199,318 discloses a method for the production of a rod or tube of a Zr-based amorphous alloy by disposing a forced cooling casting mold having a molding cavity fitted with a molten metal transfer tool on the bottom of a hearth opened on the top side, melting a zirconium alloy containing an element capable of conferring amorphousness on the alloy in the hearth, then extracting the molten metal transfer tool downwardly thereby transferring the melt of the zirconium alloy into the forced cooling casting mold, and rapidly cooling and solidifying the melt of zirconium alloy in the forced cooling casting mold thereby conferring amorphousness on the zirconium alloy.

According to the method described above, however, the cast products have their shapes limited to rods or tubes because their shapes are restricted by the shape of the molten metal transfer tool and the method of extraction of this tool. Further, this method is incapable of substantially pressing the molten alloy because the transfer of the molten alloy is induced simply by the extraction of the molten metal transfer tool. The method, therefore, incurs difficulty in yielding formed articles which are delicate or complicate in shape and the products thereof have room for improvement in terms of denseness and mechanical properties.

SUMMARY OF THE INVENTION

It is, therefore, an object of the present invention to provide a method which, owing to the combination of a technique based on the conventional metal mold casting process with the quality of an amorphous alloy exhibiting a glass transition region, allows a formed article of amorphous alloy satisfying a stated shape, dimensional accuracy, and surface quality despite complexity or delicateness of shape to be mass-produced with high efficiency by a simple process and, therefore, enables the production of even a precision machined article to omit or diminish markedly such machining steps as grinding and consequently provide an inexpensive formed article of amorphous alloy excelling in durability, strength, and resistance to impact.

It is another object of the present invention to provide an apparatus of relatively simple construction which fits the production of such formed article of amorphous alloy as mentioned above.

To accomplish the objects described above, according to the first aspect of the present invention, there is provided a method for the production of a formed article of amorphous alloy, which method is characterized by comprising melting an alloying material capable of yielding an amorphous alloy in a melting vessel, forcibly transferring the resultant molten alloy into a forced cooling casting mold provided with at least one molding cavity and meanwhile exerting pressure on the molten alloy, and rapidly cooling and solidifying the molten alloy in the forced cooling casting mold to confer amorphousness on the alloy thereby obtaining a formed article of an alloy containing an amorphous phase.

In a preferred embodiment, the steps mentioned above are carried out in a vacuum or under an atmosphere of inert gas. In another preferred embodiment, the formed article of an alloy containing an amorphous phase is obtained by melting an alloying material capable of yielding an amorphous alloy in a melting vessel having an upper open end, forcibly transferring the resultant molten alloy into the forced cooling casting mold provided with at least one molding cavity via a sprue thereof and meanwhile exerting pressure on the molten alloy, rapidly cooling and solidifying the molten alloy in the forced cooling casting mold thereby conferring amorphousness on the alloy and meanwhile gradually cooling and solidifying the molten alloy in the part of the sprue of the forced cooling casting mold thereby crystallizing the alloy in that part, cutting the part which has been embrittled by the crystallization, and thereafter separating the melting vessel from the forced cooling casting mold.

The forced transfer of the molten alloy into the forced cooling casting mold can be preferably effected by a method which comprises disposing movably in the melting vessel a molten metal transferring member adapted to effect forced transfer of the molten alloy and forcibly transferring the molten alloy held in the melting vessel into the forced cooling casting mold and meanwhile exerting pressure on the molten alloy now filling the molding cavity of the forced cooling casting mold by means of the molten metal transferring member.

Another method available for this purpose comprises disposing preparatorily the molten metal transferring member movably in the forced cooling casting mold and moving the molten metal transferring member so as to generate negative pressure inside the molding cavity and consequently induce forced transfer of the molten alloy into the molding cavity. In one preferred embodiment of this method, the molten metal transferring member to be used is furnished with a cross section conforming to that of the molding cavity of the forced cooling casting mold and slidably disposed in the molding cavity. The exertion of pressure on the molten alloy filling the molding cavity is attained by applying a pressurized gas to the molten alloy via the sprue.

In any of the methods described above, as the alloying material mentioned above, an alloy which possesses a composition represented by the following general formula and which is capable of yielding an amorphous alloy having a glass transition region of a temperature width of not less than 30K is advantageously used.

$$X_aM_bAl_c$$

wherein X represents either or both of the two elements, Zr and Hf, M represents at least one element selected from the group consisting of Mn, Fe, Co, Ni, and Cu, and a, b, and c represent such atomic percentages as respectively satisfy $25 \leqq a23\ 85$, $5 \leqq b \leqq 70$, and $0 < c \leqq 35$. This amorphous alloy contains an amorphous phase in a volumetric ratio of at least 50%.

In accordance with the second aspect of the present invention, there is provided an apparatus which can be suitably used for producing such formed article of amorphous alloy as mentioned above.

The first embodiment of the apparatus of the present invention for the production of the formed article of amorphous alloy is characterized by comprising a forced cooling casting mold which is provided in the lower part thereof with a sprue and in the inner part thereof with at least one molding cavity communicating with the sprue through the medium of a runner and further provided with a cutting member disposed in the casting mold movably in the direction of the sprue; and a melting vessel disposed under the casting mold movably in the direction of the sprue, which vessel is provided with a raw material accommodating hole having an upper open end and a molten metal transferring member disposed slidably in the raw material accommodating hole.

The second embodiment of the apparatus of the present invention is characterized by comprising a vertically movable melting vessel having a lower open end; and a forced cooling casting mold disposed under the melting vessel, which casting mold is provided with a closable sprue and at least one molding cavity adapted to establish, when the casting mold is in close contact with the lower part of the melting vessel, communication with the sprue through the medium of a runner and further with a molten metal transferring member disposed slidably in the molding cavity and a cutting member disposed in the casting mold and movable in the direction of the sprue.

Preferably in either of the embodiments described above, a closing member which is movable perpendicularly to the direction of the movement of the cutting member is interposed between the cutting member and the runner and the peripheral wall portion of the sprue and/or the closing member is made of an insulating material. Further, the forced cooling casting mold and the melting vessel mentioned above are preferably installed in a vacuum or in an atmosphere of inert gas.

BRIEF DESCRIPTION OF THE DRAWINGS

Other objects, features, and advantages of the invention will become apparent from the following description taken together with the drawings, in which.

DETAILED DESCRIPTION OF THE INVENTION

Figure 1:
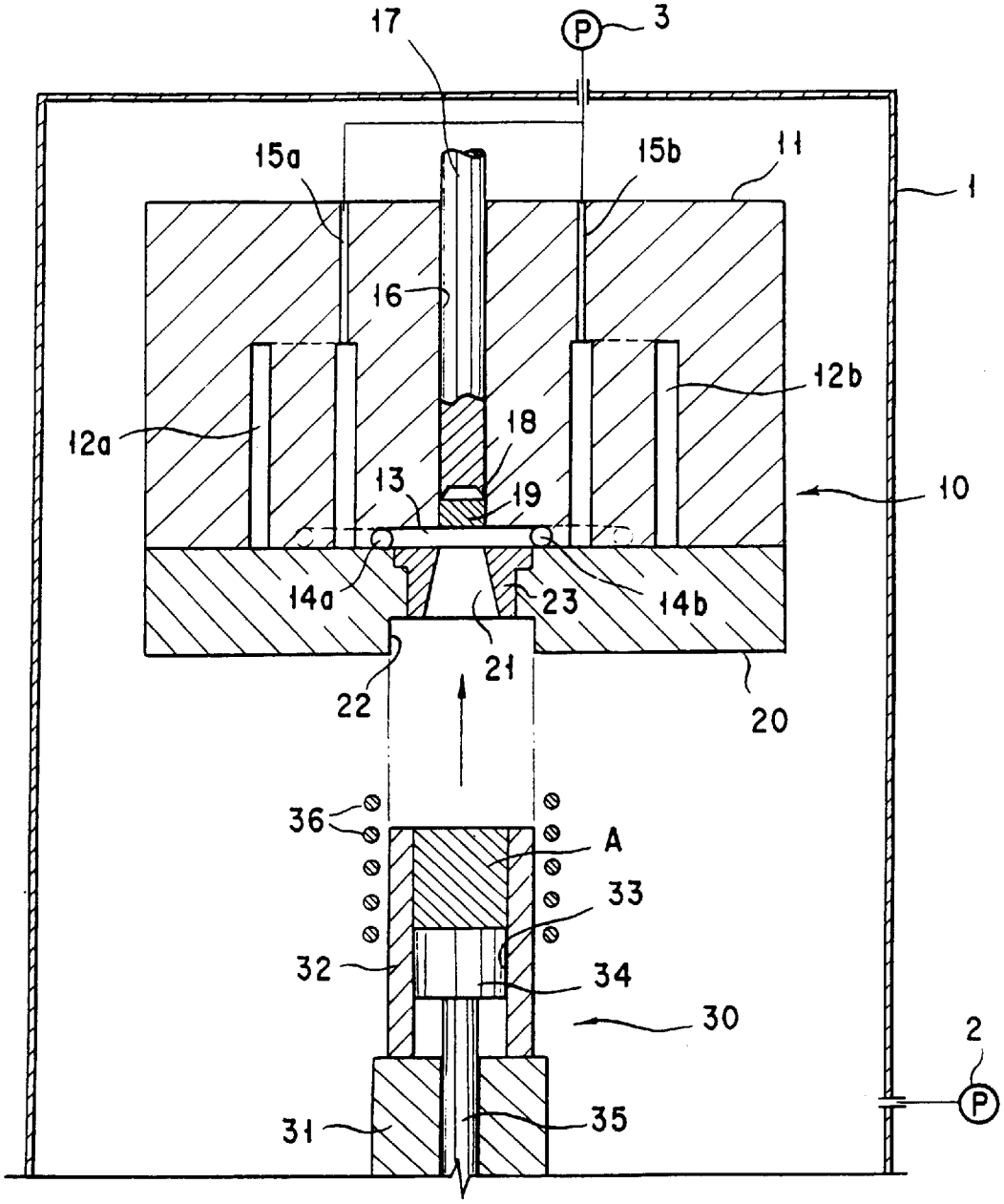
FIG. 1 is a fragmentary cross-sectional view schematically illustrating one example of the apparatus of the present invention for molding a tube.

The production of a formed article of amorphous alloy according to the present invention is characterized, as described above, by comprising melting an alloying material capable of yielding an amorphous alloy in a melting vessel, forcibly transferring the resultant molten alloy into a forced cooling casting mold provided with a cavity for molding a product and meanwhile exerting pressure on the molten alloy, and rapidly cooling and solidifying the molten alloy in the casting mold to obtain a formed article of an alloy containing an amorphous phase. In this case, the forced transfer of the molten alloy into the molding cavity of the forced cooling casting mold can be attained by a method which comprises causing a molten metal transferring member disposed slidably in the melting vessel to be actuated by a hydraulic or pneumatic cylinder, for example, thereby inducing forced transfer of the molten alloy held in the vessel into the molding cavity of the casting mold and meanwhile pressing the molten alloy filling in the molding cavity or a method which comprises having the molten metal transferring member preparatorily disposed slidably inside the molding cavity of the casting mold, moving the molten metal transferring member so as to induce generation of negative pressure in the molding cavity and effecting forced transfer of the molten alloy into the molding cavity and meanwhile adding a gas pressure to the melting vessel.

These methods, owing to the fact that the molten alloy which is placed in the molding cavity of the forced cooling casting mold is held in a pressed state, enable a formed article even in a complicated shape or a delicate shape to be mass-produced efficiently and therefore inexpensively by a simple process. Thus, the resultant formed article faithfully reproduces the contour of the molding cavity with high dimensional accuracy and acquires high denseness and smooth surface.

Further by carrying out the component steps of the process mentioned above in a vacuum or under an atmosphere of inert gas, the molten alloy can be prevented from producing an oxide film and the formed article of amorphous alloy can be manufactured in highly satisfactory quality. For the purpose of preventing the molten metal from producing an oxide film, it is preferable to have the apparatus in its entirety disposed in a vacuum or in an atmosphere of inert gas such as Ar gas or to sweep at least the upper part of the melting vessel exposing the molten alloy to the ambient air with a stream of inert gas.

In the apparatus of the present invention for the production of a formed article of amorphous alloy, a cutting member is disposed in the forced cooling casting mold so as to be movable in the direction of a sprue of the casting mold and, after completion of the solidification of the molten alloy, enabled to sever the hardened portion persisting in the sprue or additionally inside the melting vessel from the cast article placed and hardened in the casting mold and allow easy separation of the melting vessel and the casting mold subsequently to completion of the casting step. As a result, the next casting step can be carried out smoothly with improved operational efficiency.

Preferably, the peripheral wall part of the sprue and/or a closing member interposed between the cutting member and a runner of the casting mold and allowed to move perpendicularly to the direction of transfer of the cutting member are made of an insulating material so that these parts may cool at a lower rate than the interior of the molding cavity. By insulating the sprue as described above, the flow of the molten alloy is smoothed and the molten alloy poured into the molding cavity of the casting mold is rapidly cooled and solidified and allowed to assume amorphousness. Since the molten alloy lodged in the part of the sprue is slowly cooled and solidified and consequently crystallized, the part which is embrittled by this crystallization can be cut easily.

The material for the formed article of the present invention does not need to be limited to any particular substance but may be any of the materials which are capable at all of furnishing a product formed substantially of amorphous alloy. Among other materials answering this description, the Zr—TM—Al and Hf—TM—Al (TM: transition metal) amorphous alloys represented by the general formula mentioned above and having very wide differences between the glass transition temperature (Tg) and the crystallization temperature (Tx) exhibit high strength and high corrosion resistance, possess wide supercooled liquid ranges (glass transition ranges), $\Delta Tx = Tx - Tg$, of not less than 30K, and extremely wide supercooled liquid ranges of not less than 60K in the case of the Zr—TM—Al amorphous alloys. In the above temperature ranges, these amorphous alloys manifest very satisfactory workability owing to viscous flow even at such low stress not more than some tens MPa. They are characterized by being produced easily and very stably as evinced by the fact that they are enabled to furnish an amorphous bulk material even by a casting method using a cooling rate of the order of some tens K/s. The aforementioned Zr—TM—Al and Hf—TM—Al amorphous alloys are disclosed in U.S. Pat. No. 5,032,196 issued Jul. 16, 1991 to Masumoto et al., the teachings of which are hereby incorporated by reference. By the metal mold casting from melt and by the molding process utilizing the viscous flow resorting to the glass transition range as well, these alloys produce amorphous materials and permit very faithful reproduction of the shape and size of a molding cavity of a metal mold.

The Zr—TM—Al and Hf—TM—Al amorphous alloys to be used in the present invention possess very large range of $\Delta Tx$, though variable with the composition of alloy and the method of determination. The $Zr_{60}Al_{15}Co_{2.5}Ni_{7.5}Cu_{15}$ alloy (Tg: 652K, Tx: 768K), for example, has such an extremely wide $\Delta Tx$ as 116K. It also offers very satisfactory resistance to oxidation such that it is hardly oxidized even when it is heated in the air up to the high temperature of Tg. The Vickers hardness (Hv) of this alloy at temperatures from room temperature through the neighborhood of Tg is 460 (DPN), the tensile strength thereof is 1,600 MPa, and the bending strength thereof is up to 3,000 MPa. The thermal expansion coefficient, $\alpha$ of this alloy from room temperature through the neighborhood of Tg is as small as $1\times10^{-5}$/K, the Young's modulus thereof is 91 GPa, and the elastic limit thereof in a compressed state exceeds 4–5%. Further, the toughness of the alloy is high such that the Charpy impact value falls in the range of 6–7 J/cm$^2$. This alloy, while exhibiting such properties of very high strength as mentioned above, has the flow stress thereof lowered to the neighborhood of 10 MPa when it is heated up to the glass transition range thereof. This alloy, therefore, is characterized by being worked very easily and being manufactured with low stress into minute parts and high-precision parts complicated in shape. Moreover, owing to the properties of the so-called glass (amorphous) substance, this alloy is characterized by allowing manufacture of formed (deformed) articles with surfaces of extremely high smoothness and having substantially no possibility of forming a step which would arise when a slip band appeared on the surface as during the deformation of a crystalline alloy.

Generally, an amorphous alloy begins to crystallize when it is heated to the glass transition range thereof and retained therein for a long time. In contrast, the aforementioned alloys which possess such a wide $\Delta Tx$ range as mentioned above enjoy a stable amorphous phase and, when kept at a temperature properly selected in the $\Delta Tx$ range, avoid producing any crystal for a duration up to about two hours. The user of these alloys, therefore, does not need to feel any anxiety about the occurrence of crystallization during the standard molding process.

The aforementioned alloys manifest these properties unreservedly during the course of transformation thereof from the molten state to the solid state. Generally, the manufacture of an amorphous alloy requires rapid cooling. In contrast, the aforementioned alloys allow easy production of a bulk material of a single amorphous phase from a melt by the cooling which is effected at a rate of about 10 K/s. The solid bulk material consequently formed also has a very smooth surface. The alloys have transferability such that even a scratch of the order of microns inflicted by the polishing work on the surface of a metal mold is faithfully reproduced.

When the aforementioned alloys are adopted as the alloying material, therefore, the metal mold to be used for producing the formed article is only required to have the surface thereof adjusted to fulfill the surface quality expected of the article because the article produced faithfully reproduces the surface quality of the metal mold. In the conventional metal mold casting method, therefore, these alloys allow the steps for adjusting the size and the surface roughness of the molded article to be omitted or diminished.

The characteristics of the aforementioned amorphous alloys which combine high tensile strength and high bending strength, satisfactory Young's modulus, high elastic limit, high impact resistance, fine surface smoothness, and castability or workability of high precision can be advantageously applied to formed articles in various fields such as, for example, precision parts represented by ferrules and sleeves in optical fiber connectors, toothed wheels, and micromachines.

The amorphous alloys represented by the general formula, $X_aM_bAl_c$, mentioned above manifest the same characteristics as mentioned above even when they incorporate such elements as Ti, C, B, Ge, or Bi at a ratio of not more than 5 atomic %.

Now, the present invention will be described more specifically below with reference to embodiments illustrated in the drawings annexed hereto.

FIG. 1 schematically illustrates the construction of one example of the apparatus for producing a tube of amorphous alloy by the method of the present invention.

A forced cooling casting mold 10 is a split mold composed of an upper mold 11 and a lower mold 20. The upper mold 11 has a pair of molding cavities 12*a* and 12*b* formed therein and adapted to define the outside dimension of a cast article. These cavities 12*a* and 12*b* intercommunicate through the medium of a runner 13 such that the molten metal flows through the leading ends of such parts 14*a* and 14*b* of the runner as half encircle the peripheries of the cavities 12*a* and 12*b* at a prescribed distance into the cavities 12*a* and 12*b*. In the upper mold 11, air vents 15*a* and 15*b* are formed as extended from the upper ends of the cavities 11*a* and 11*b* through the upper side of the upper mold. These air vents 15*a* and 15*b* are connected to a vacuum pump 3. Optionally, the air vents 15*a* and 15*b* may be utilized as simple ducts for spent gas instead of being connected to the vacuum pump 3.

A sprue (through hole) 21 communicating with the runner 13 mentioned above is formed at a pertinent position of the lower mold 20. Underneath the sprue 21 is formed a depression 22 which is shaped to conform with a cylindrical raw material accommodating part 32 constituting itself an upper part of a melting vessel 30. To the sprue 21 of the lower mold 20, an inlet ring or sprue bush 23 made of such insulating material as a ceramic substance or a metal of small thermal conductivity is fitted. The sprue 21 (the inner wall of the sprue bush 23) is diverged downwardly to form a truncated cone space so that the molten alloy is smoothly introduced into the molding cavity.

Further in the upper mold 11, a vertical through hole 16 is formed above the upper part of the sprue 21. In the through hole 16, a rodlike cutting member 17 having a cutting edge 18 formed along the circular edge of the lower end thereof is disposed so as to be vertically reciprocated in the direction of the sprue 21. The cutting member 17 is actuated by a hydraulic cylinder (or a pneumatic cylinder) disposed thereover and not shown in the diagram. A closing member or closing rod 19 is interposed between the lower end of the cutting member 17 and the runner 13. This closing member 19, as clearly shown in FIG. 2, has ridges 24 raised from the opposite side faces thereof and meshed with grooves 26 in a hole 25 formed in the horizontal direction in the upper mold so that the closing member 19 is slidable in the perpendicular direction relative to the direction of the motion of the cutting member 17 (in the bearings of the diagram, in the perpendicular direction to the face of paper). The closing member 19, during the introduction of the molten alloy, has the leading end part thereof thrust into the through hole 16 so as to prevent the molten alloy from being poured into the through hole 16. After the molten alloy has been poured and solidified, the closing member 19 retracts to the extent of opening the lower part of the through hole 16 and causing the cutting edge 18 at the lower end of the cutting member 17 to protrude as far as the sprue 21. The closing member 19 is preferred to be made of such insulating material as mentioned above.

While the forced cooling casting mold 10 can be made of such metallic material as copper, copper alloy, cemented carbide or superalloy, it is preferred to be made of such material as copper or copper alloy which has a large thermal capacity and high thermal conductivity for the purpose of heightening the cooling rate of the molten alloy poured into the cavities 12*a* and 12*b*. The upper mold 11 has disposed therein such a flow channel as allow flow of a cooling medium like cooling water or cooling gas. The flow channel is omitted from the drawing by reason of limited space.

The melting vessel 30 is provided in the upper part of a main body 31 thereof with the cylindrical raw material accommodating part or pot 32 and is disposed directly below the sprue 21 of the lower mold 20 so as to be reciprocated vertically. In a raw material accommodating hole 33 of the raw material accommodating part 32, a molten metal transferring member or piston 34 having nearly the same diameter as the raw material accommodating hole 33 is slidably disposed. The molten metal transferring member 34 is vertically moved by a plunger 35 of a hydraulic cylinder (or pneumatic cylinder) not shown in the diagram. An induction coil 36 as a heat source is disposed so as to encircle the raw material accommodating part 32 of the melting vessel 30. As the heat source, any arbitrary means such as one resorting to the phenomenon of resistance heating may be adopted besides the high-frequency induction heating. The material of the raw material accommodating part 32 and that of the molten metal transferring member 34 are preferred to be such heat-resistant material as ceramics or metallic materials coated with a heat-resistant film.

For the purpose of preventing the molten metal from forming an oxide film, the forced cooling casting mold 10 and the melting vessel 30 are disposed in a chamber 1. The apparatus in its entirety is maintained in a vacuum by actuating a vacuum pump 2 which is connected to the interior of the chamber 1. Otherwise, an inert gas such as Ar gas is introduced into the chamber 1 to establish an atmosphere of the inert gas and enclose the relevant parts with the atmosphere.

In preparation for the production of a tube of amorphous alloy, first the alloying raw material A of such a composition capable of yielding an amorphous alloy as mentioned above is placed in the empty space overlying the molten metal transferring member 34 inside the raw material accommodating part 32 while the melting vessel 30 is held in a state separated downwardly from the forced cooling casting mold 10. The alloying raw material A to be used may be in any of the popular forms such as rods, pellets, and minute particles.

Subsequently, the vacuum pump 2 is actuated to reduce the inner pressure of the chamber 2 or the Ar gas is introduced to create an inert atmosphere. Thereafter, the induction coil 36 is excited to heat the alloying raw material A rapidly. After the fusion of the alloying raw material A has been confirmed by detecting the temperature of the molten metal, the induction coil 36 is demagnetized and the melting vessel 30 is elevated until the upper end thereof is inserted in the depression 22 of the lower mold 20. At this time, the closing member 19 thrusts into the lower part of the through hole 16 and the communication between the through hole 16 and the runner 13 is blocked.

Figure 2:
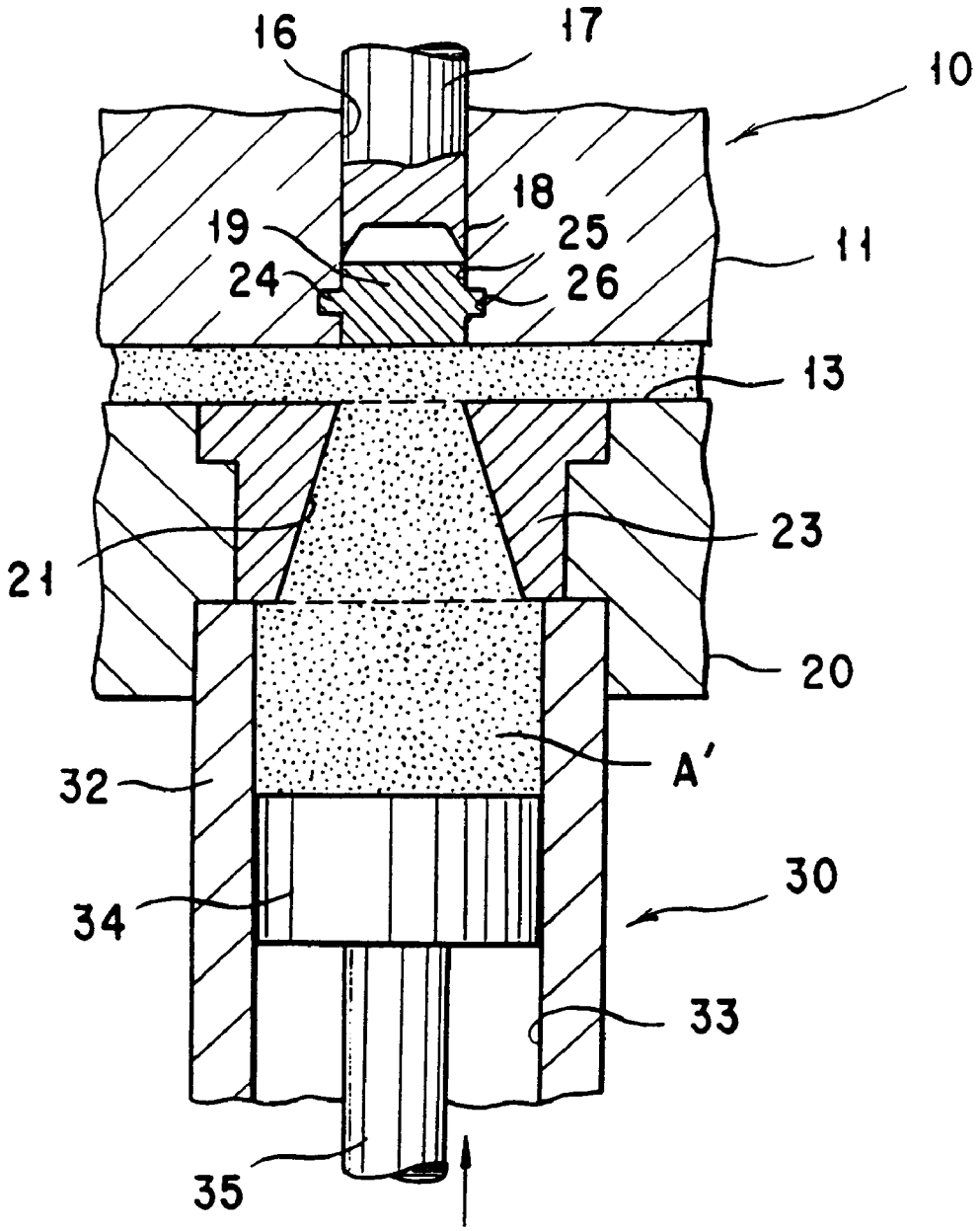
FIG. 2 is a fragmentary cross-sectional view illustrating the essential part of the apparatus shown in FIG. 1 during the injection of molten alloy.

Then, the vacuum pump 3 is actuated to lower the pressure in the cavities 12*a* and 12*b* of the forced cooling casting mold 10 below the pressure in the chamber 1. Thereafter, the hydraulic cylinder (not shown) is actuated to effect rapid elevation of the molten metal transferring member 34 and injection of the molten metal A' through the sprue 21 of the casting mold 10 as illustrated in FIG. 2. The injected molten metal A' is advanced through the runner 13, introduced into the cavities 12*a* and 12*b*, and compressed and rapidly solidified therein. In this case, the cooling rate exceeding $10^3$ K/s can be obtained by suitably setting the injection temperature, the injection speed, etc.

Figure 3:
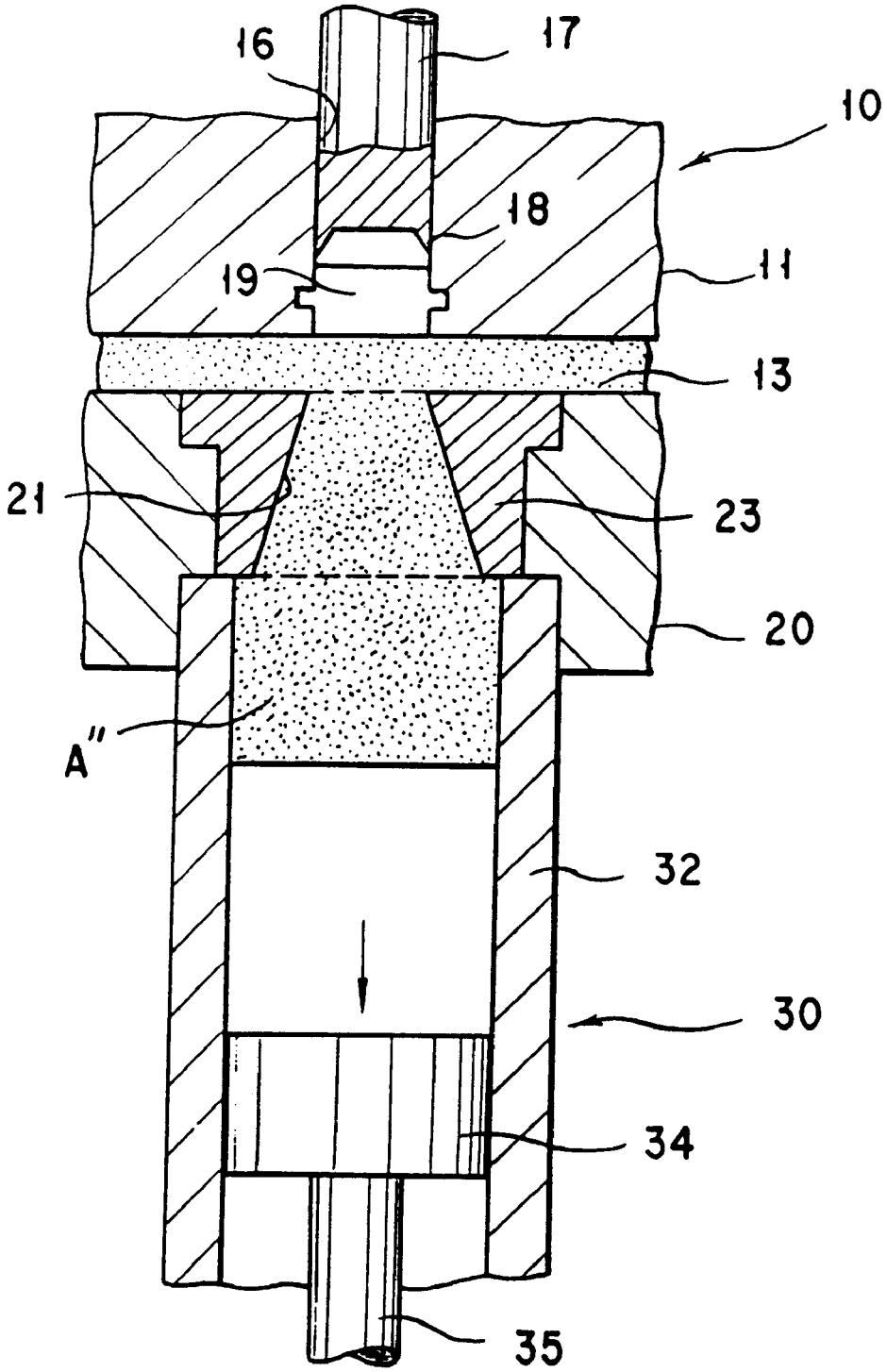
FIG. 3 is a fragmentary cross-sectional view illustrating the essential part of the apparatus shown in FIG. 1 after the molten metal has solidified.
Figure 4:
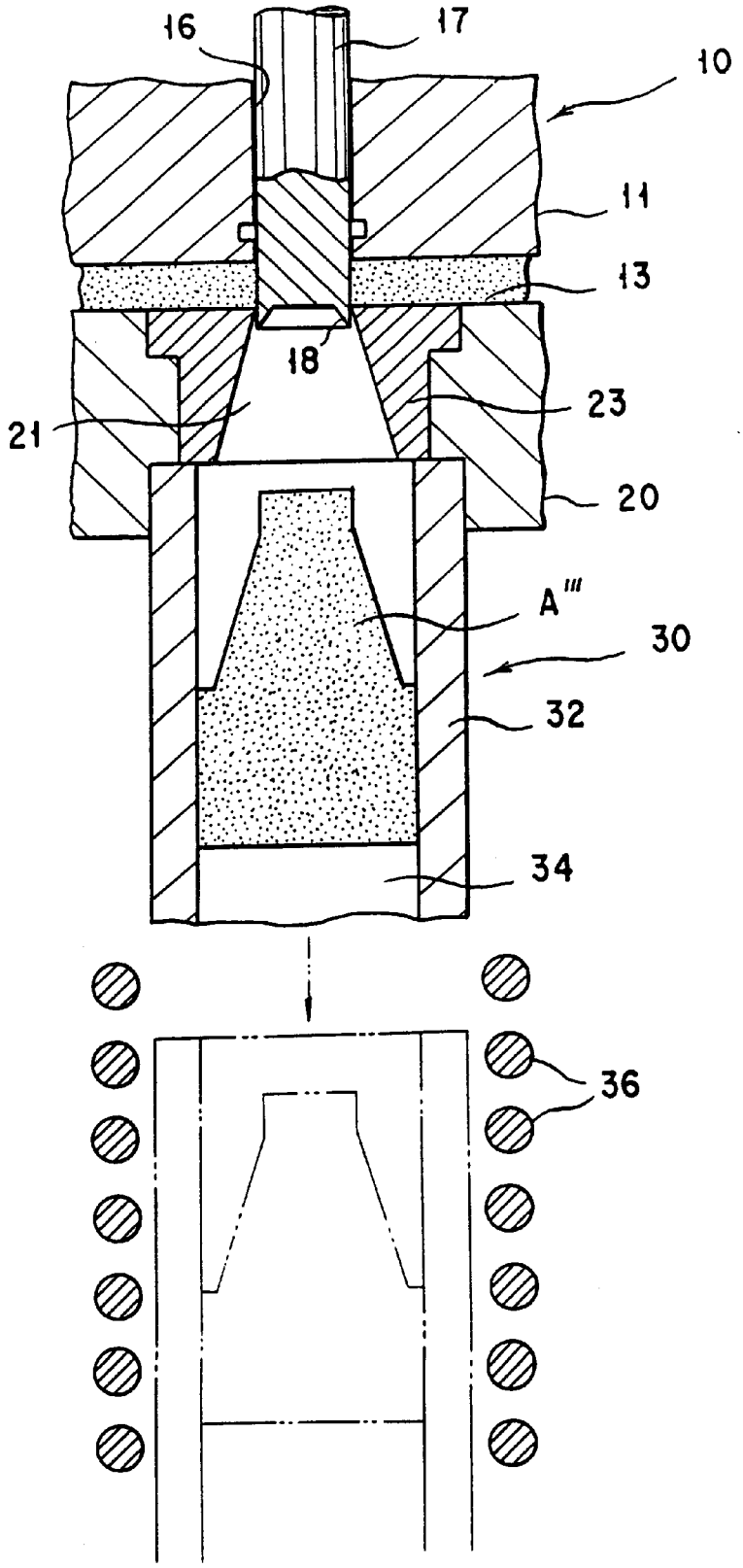
FIG. 4 is a fragmentary cross-sectional view illustrating the essential part of the apparatus shown in FIG. 1 after the solidified material has been cut.

After the molten metal charged in the cavities has been solidified, the closing member 19 is retracted to open the lower part of the through hole 16 as illustrated in FIG. 3 and then the hydraulic cylinder (not shown) is actuated to effect rapid downward thrust of the cutting member 17 and consequent severance of the runner part of a solidified material A" by the cutting edge 18 thereof as illustrated in FIG. 4. At this time, the solidified material A" lodged in the peripheral part of the sprue 21 can be easily cut by the cutting member 17 because it is made to cool at a lowered rate and is consequently crystallized and embrittled owing to the use of an insulating material for the sprue bush 23 and the closing member 19. A solidified material A" in the severed portion of the sprue 21 is dropped into the raw material accommodating part 32 of the melting vessel 30 and put to reuse.

Then, after the melting vessel 30 has been returned to the home position thereof as indicated by an imaginary line in FIG. 4 and the cutting member 17 has been elevated, the leading end part of the closing member 19 is advanced until the lower part of the through hole 16 is closed.

Thereafter, the upper mold 11 and the lower mold 20 are separated from each other and the cast article is extracted from the interior of the forced cooling casting mold 10 to complete the first round of the production step.

Figure 5:
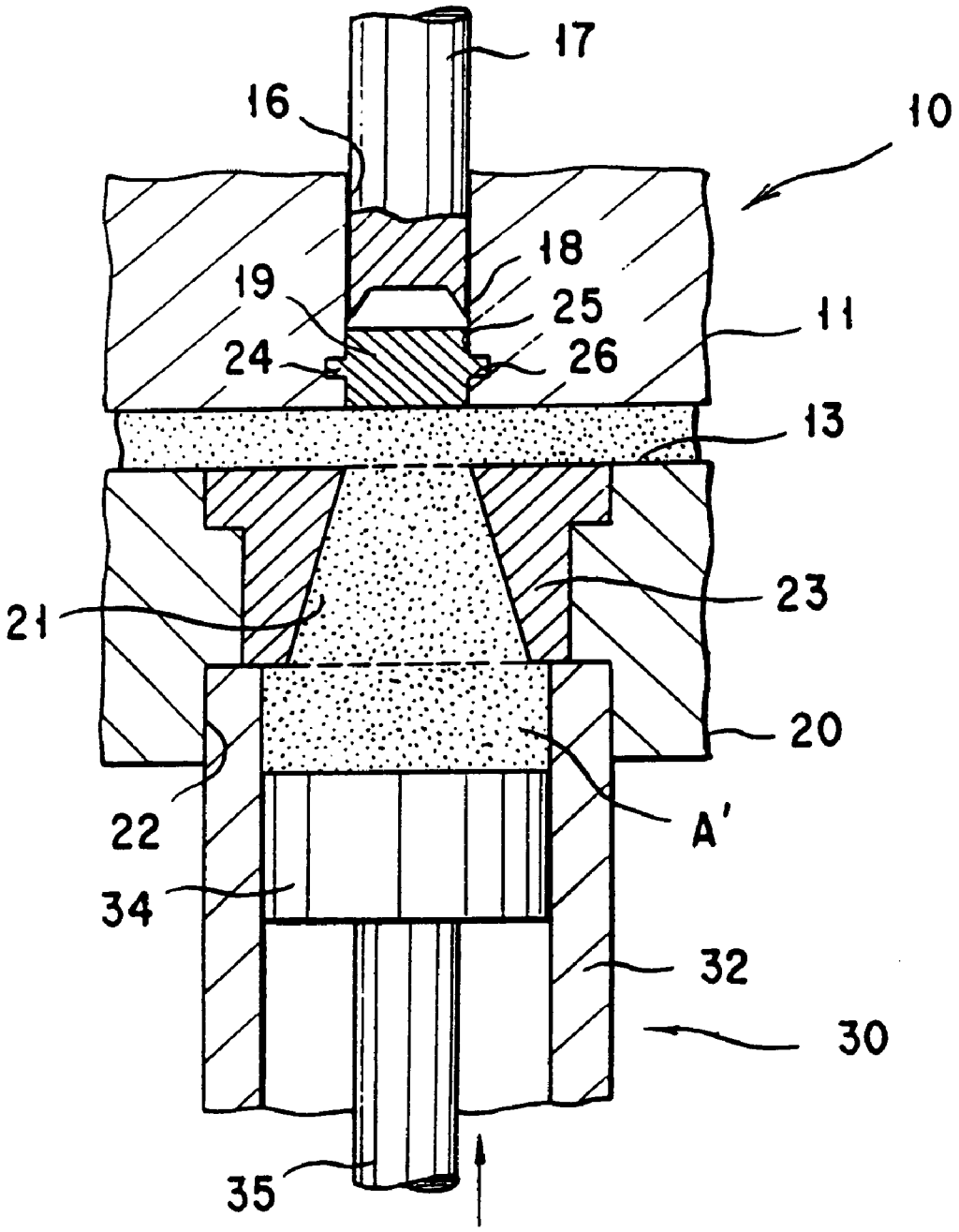
FIG. 5 is a fragmentary cross-sectional view illustrating the essential part of the apparatus shown in FIG. 1 during the reinjection of molten alloy.

In the next round of the production step, the melting vessel 30 is replenished, as occasion demands, with the alloying raw material A and the, similarly in the step described above, the alloying raw material A is melted, the melting vessel 30 is elevated until the upper end of the raw material accommodating part 32 is inserted in the depression 22 of the lower mold 20, and the molten metal transferring member 34 is rapidly elevated as illustrated in FIG. 5 to effect the second round of injection. Thereafter, the second round of production step is completed by repeating the same procedure as described above. The step of the procedure described above is then repeated.

Figure 6:
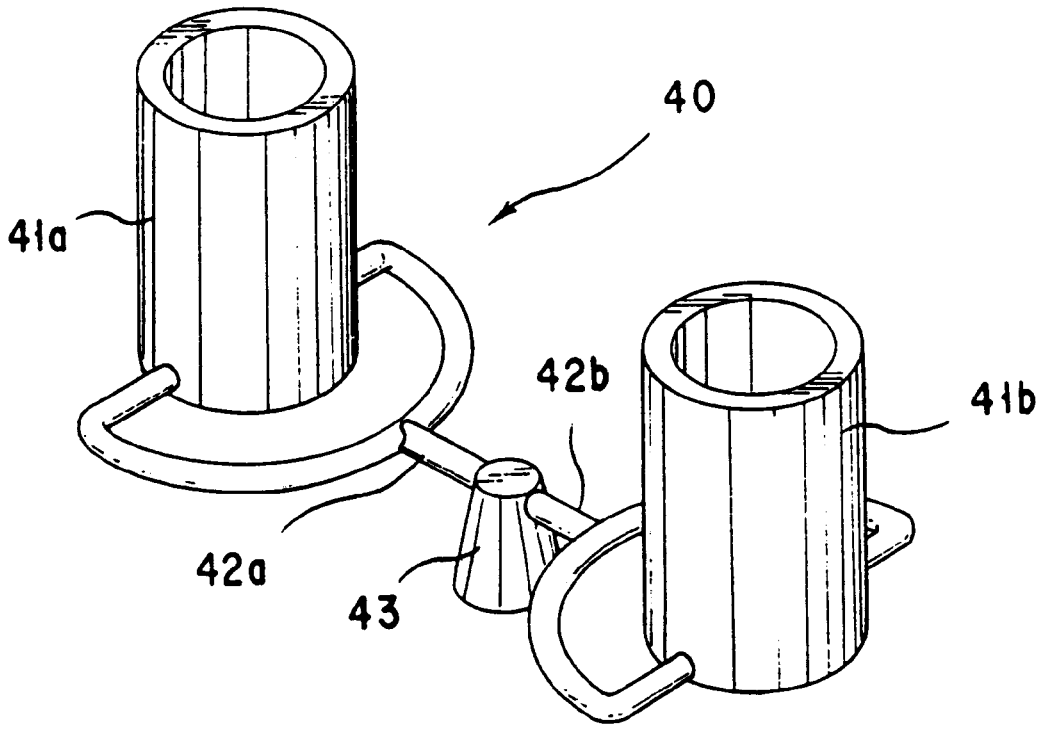
FIG. 6 is a perspective view illustrating a cast article produced by the apparatus shown in FIG. 1.
Figure 7:
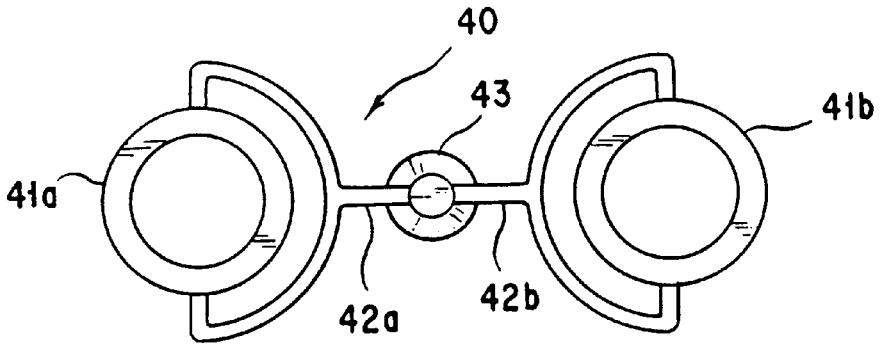
FIG. 7 is a plan view of the cast article shown in FIG. 6.

The shape of the cast article produced by the method described above is illustrated in FIG. 6 and FIG. 7. Tubes having a smooth surface faithfully reproducing the cavity surface of the casting mold are obtained by severing runner parts 42*a* and 42*b* from cylindrical parts 41*a* and 41*b* of a cast article 40 and grinding the cut faces of the cylindrical parts 41*a* and 41*b* remaining after the severance. Though the runner parts 42*a* and 42*b* and a sprue part 43 of the cast article 40 have been already severed by the cutting member 17 as described above, they are depicted in a connected state in FIG. 6 and FIG. 7 to facilitate comprehension of the shapes of the molding cavities 12*a* and 12*b*, and runners 13 and semicircular parts 14*a* and 14*b* thereof of the forced cooling casting mold 10 illustrated in FIG. 1.

The method described above allows manufacture of tubes which have a dimensional accuracy, L, ±0.0005 to ±0.001 mm and a surface accuracy 0.2–0.4 $\mu$m.

The apparatus, as described above with reference to FIG. 1, uses a forced cooling casting mold 10 forming a pair of molding cavities 12*a* and 12*b* and manufactures two products by a single step. It is naturally permissible to use a forced cooling casting mold forming three or more cavities and manufactures that many products. One example of such manufacture of a multiplicity of cast articles is illustrated in FIG. 8.

Figure 8:
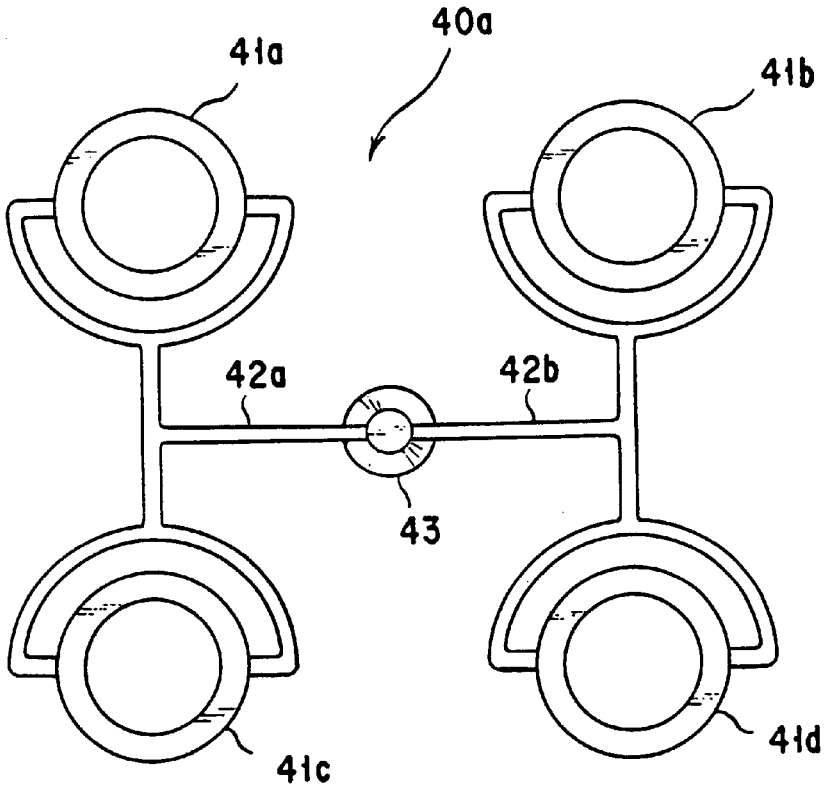
FIG. 8 is a plan view illustrating another example of cast article.

FIG. 8 depicts a cast article 40*a* having four cylindrical parts 41*a*, 41*b*, 41*c*, and 41*d* joined to runner parts 42*a* and 42*b*. A larger number of cast articles can be manufactured by a single step, when necessary, by having as many molding cavities disposed around the sprue 21 of the forced cooling casting mold 10.

The high-pressure mold casting method described above allows a casting pressure up to about 100 MPa and an injection speed up to about several m/s and enjoys the following advantages.

(1) The charging of the forced cooling casting mold with the molten metal completes within several milliseconds and this quick charging adds greatly to the action of rapid cooling.

(2) The highly close contact of the molten metal to the forced cooling casting mold adds to the speed of cooling and allows precision molding of molten metal as well.

(3) Such faults as shrinkage cavities possibly occurring during the shrinkage of a cast article due to solidification can be allayed.

(4) The method allows manufacture of a formed article in a complicated or delicate shape.

(5) The method permits smooth casting of a highly viscous molten metal.

Figure 9:
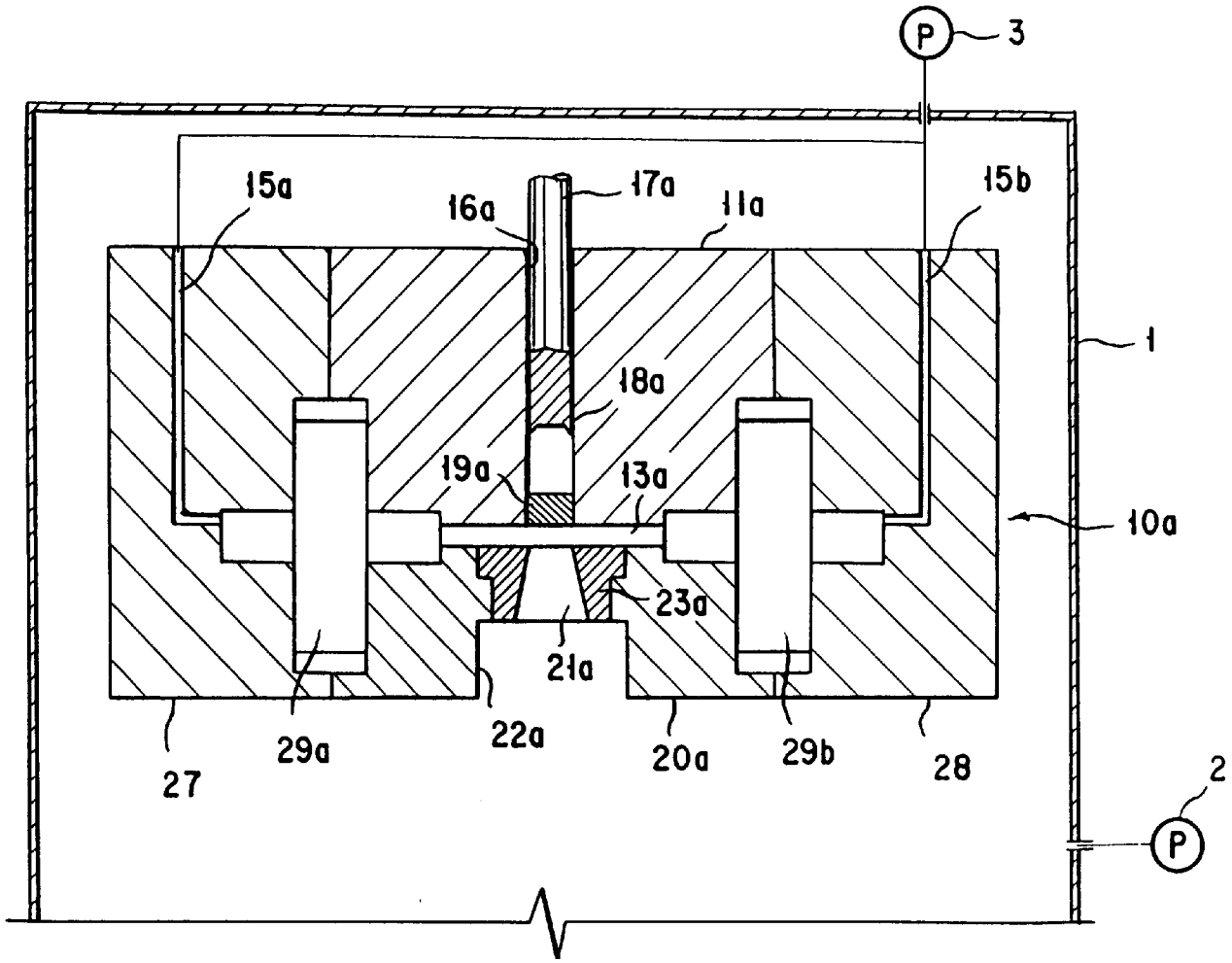
FIG. 9 is a fragmentary cross-sectional view illustrating schematically one example of the forced cooling casting mold for the formation of a toothed wheel according to the present invention.

FIG. 9 depicts schematically the construction of one example of the apparatus for producing a toothed wheel of amorphous alloy according to the method of the present invention.

In the apparatus illustrated in FIG. 9, a forced cooling casting mold 10*a* is composed of an upper mold 11*a*, a lower mold 10*a*, and one pair of laterally opposite molds 27 and 28. This casting mold 10*a* is different from the forced cooling casting mold 10 illustrated in FIG. 1 in respect that one pair of product molding cavities 29*a* and 29*b*conforming with the contour of a produced toothed wheel are interposed respectively between the upper and lower molds 11*a* and 20*a* and the left mold 27 and the right mold 28. Since such component parts of the casting mold as a sprue 21*a*, a sprue bush 23*a* surrounding the sprue 21*a*, a cutting member 17*a* disposed vertically movably thereabove, and a closing member 19*a* disposed thereunder are identical in material and structure to the corresponding component parts of the forced cooling casting mold illustrated in FIG. 1, their description will be omitted herein.

A melting vessel adapted to reciprocate freely in the vertical direction is disposed below the sprue 21*a* of the forced cooling casting mold 10*a*. Since this melting vessel is identical in construction with that of the apparatus illustrated in FIG. 1, the illustration thereof is omitted herein. The forced cooling casting mold 10*a* and the melting vessel are disposed in the chamber 1.

Since the process of production by the use of the apparatus shown in FIG. 9 is similar in the production by the apparatus illustrated in FIG. 1, therefore, the description thereof is omitted herein.

Figure 10:
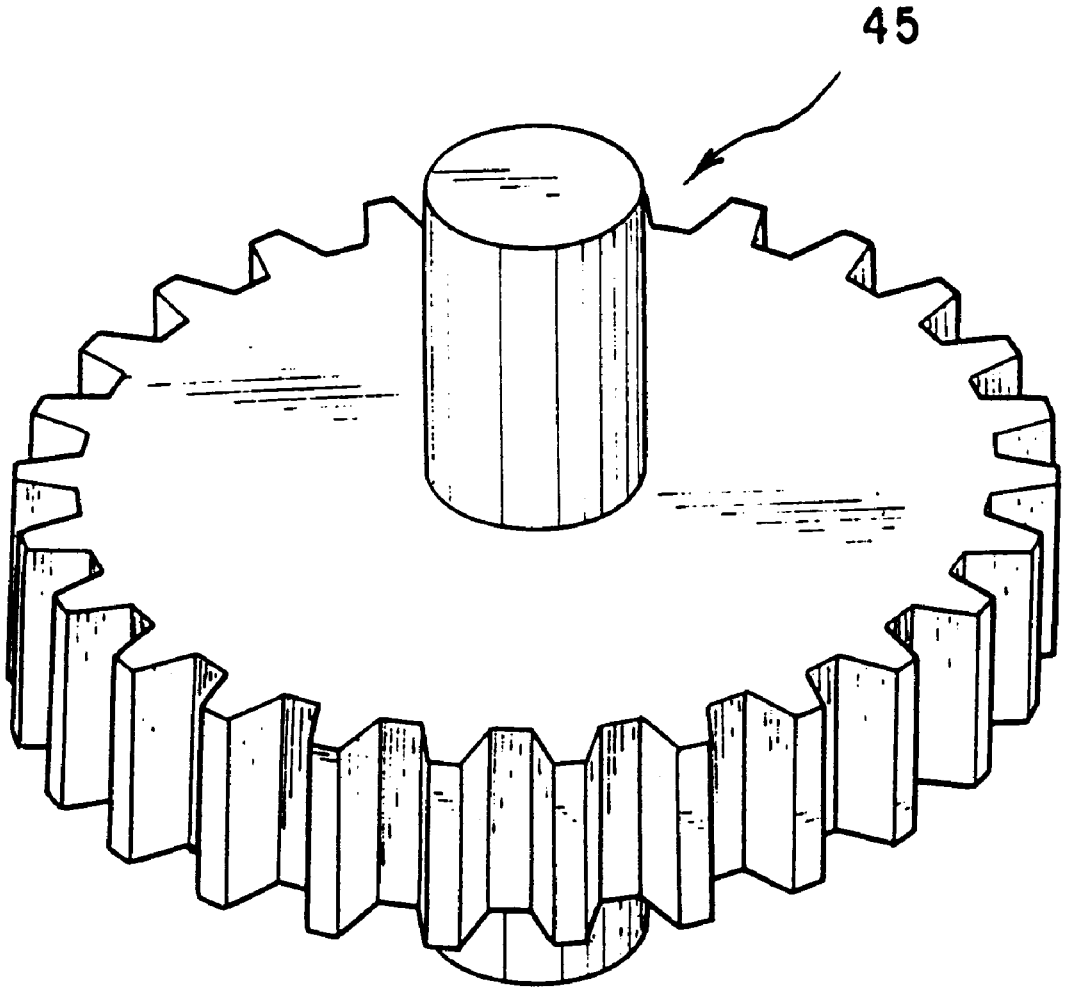
FIG. 10 is a perspective view illustrating a toothed wheel produced by the forced cooling casting mold shown in FIG. 9.

Use of the forced cooling casting mold 10*a* illustrated in FIG. 9 allows manufacture by casting of such a toothed wheel 45 of amorphous alloy as illustrated in FIG. 10.

Figure 11:
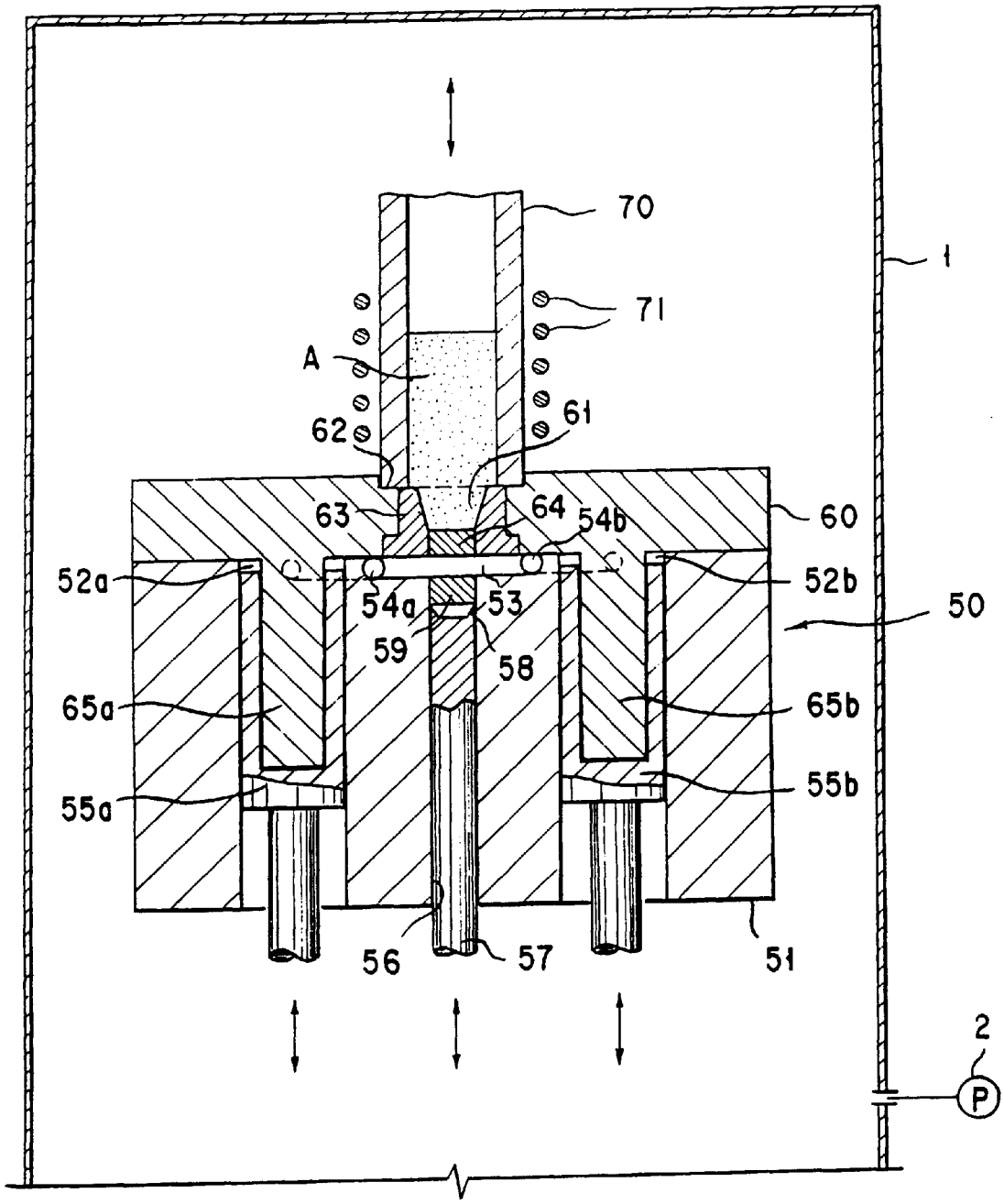
FIG. 11 is a fragmentary cross-sectional view illustrating schematically another example of the apparatus for the formation of a tube according to the present invention.

FIG. 11 depicts an example of the apparatus for producing a tube of amorphous alloy by another method of the present invention.

This apparatus has a construction such that a lower mold 51 and an upper mold 60 of a forced cooling casting mold 50 are substantially reciprocal in layout to the upper mold 11 and the lower mold 20 of the forced cooling casting mold 10 illustrated in FIG. 1. Specifically, the lower mold 51 has a pair of molding cavities 52*a* and 52*b* for defining the outside dimension of the tube. Then, in these cavities 52*a* and 52*b*, cores 65*a* and 65*b* for defining the inside dimension of the tube are disposed respectively. These cores 65*a* and 65*b* are raised from the lower side of the upper mold 60. The cavities 52*a* and 52*b* intercommunicate through the medium of a runner 53 such that the molten metal flows through the leading end of such parts 54*a* and 54*b* of the runner 53 as half encircle the peripheries of the cavities 52*a* and 52*b* at a prescribed distance into the cavities 52*a* and 52*b*. The cylindrical parts of molten metal transferring members 55*a* and 55*b* which are adapted to reciprocate freely in the vertical direction are disposed slidably in the empty spaces between the cavities 52*a* and 52*b* and the cores 65*a* and 65*b*. Inside a vertical through hole 56 formed in the lower part of the runner 53, a rodlike cutting member 57 having a cutting edge 58 formed along the periphery of the upper end thereof is disposed movably toward a sprue 61. Further, between the upper end of the cutting member 57 and the runner 53, a closing member 59 is slidably disposed perpendicularly to the direction of movement of the cutting member 57. The structures of the cutting member 57 and the closing member 59 and the operating mechanisms of the molten metal transferring members 55*a* and 55*b*, the cutting member 57, and the closing member 59 are similar to those in the apparatus illustrated in FIG. 1, excepting that they are reciprocal in layout.

The sprue (through hole) 61 communicating with the runner 53 mentioned above is formed at a pertinent position of the upper mold 60 and a depression 62 conforming with the lower end part of a cylindrical melting vessel 70 is formed in the upper edge part of the sprue 61. A sprue bush 63 made of an insulating material and having a diverging inner diameter is fitted to the sprue 61 of the upper mold 60 and a closing member 64 made of an insulating material and having the same structure as the closing member 59 mentioned above is disposed in the lower end part of the sprue bush 63 in such a manner as to be slidably moved in a direction perpendicular to the direction of the axial line of the sprue 61 (the direction of movement of the cutting member 57).

The melting vessel 70 is a cylindrical container and is disposed directly above the sprue 61 of the upper mold 60 in such a manner as to be freely reciprocated in the vertical direction. It is encircled with an induction coil 71.

The forced cooling casting mold 50 and the melting vessel 70 are disposed within the chamber 1 similarly in the apparatus shown in FIG. 1.

In preparation for the production of a tube by the use of the apparatus shown in FIG. 11, first the melting vessel 70 is lowered. Now, the melting vessel 70, with the lower end thereof fitted in the depression 62 of the upper mold 60 of the forced cooling casting mold 50, is charged with the alloying raw material A of a composition capable of yielding such amorphous alloy as mentioned above. Then, the induction coil 71 is excited to heat the alloying raw material A rapidly. After the alloying raw material A has been melted, the induction coil 71 is demagnetized, the closing member 64 is retracted to open the lower part of the sprue 61, the molten metal transferring members 55*a* and 55*b* are rapidly lowered to generate negative pressure in the molding cavities 52*a* and 52*b*, the molten metal is aspirated from the sprue 61 via the runner 53 into the cavities 52*a* and 52*b* and, meanwhile, a pressurized gas is introduced into the melting vessel 70 to press the molten metal.

After the molten metal filling the cavities has been solidified, the melting vessel 70 is elevated and, similarly in the apparatus illustrated in FIG. 1, the closing member 59 is retracted to open the upper part of the through hole 56, then the hydraulic cylinder (not shown) is actuated to effect rapid upward thrust of the cutting member 57, and the cutting edge 58 of the cutting member 57 is caused to sever the runner part of the solidified material. At this time, the solidified material lodged in the sprue 61 can be easily cut by the cutting member 57 because it is made to cool at a lowered rate and is consequently crystallized and embrittled owing to the use of an insulating material for the sprue bush 63 and the closing member 59. The solidified material in the portion of the sprue 61 severed from the cast product is removed from the upper mold and put to reuse.

After the cutting member 57 has lowered subsequently, the leading end parts of the closing member 59 and 64 advance and respectively close the upper part of the through hole 56 and the lower part of the sprue 61.

Thereafter, the upper mold 60 and the lower mold 51 are separated and the molten metal transferring members 55*a* and 55*b* are elevated to eject the cast article from the forced cooling casting mold 50 and complete the first round of the step of production.

Now, the mechanical properties of the aforementioned amorphous alloys will be described below with reference to the results of the test therefor. The specimens were manufactured as follows:

Various alloys including $Zr_{60}Al_{15}Co_{2.5}Ni_{7.5}Cu_{15}$ and shown in the following table were manufactured by melting relevant component metals. They were each placed in a quartz crucible and melted thoroughly by high-frequency induction heating. The melt was injected under a gaseous pressure of 2 kgf/cm$^2$ through a slender hole formed in the lower part of the crucible into a copper mold provided with a cylindrical cavity, 2 mm in diameter and 30 mm in length, and kept at room temperature to obtain a rod-like specimen for the determination of mechanical properties. The results of this determination are shown in the table.

TABLE

| Alloy used | Tensile strength (MPa) | Bending strength (MPa) | α $10^{-5}$/K (room temperature-Tg) | E (GPa) | Hardness Hv | Tg (K) | Tx (K) |
|---|---|---|---|---|---|---|---|
| $Zr_{67}Cu_{33}$ | 1,880 | 3,520 | 0.8 | 99 | 540 | 603 | 669 |
| $Zr_{65}Al_{7.5}Cu_{27.5}$ | 1,450 | 2,710 | 0.8 | 93 | 420 | 622 | 732 |
| $Zr_{65}Al_{7.5}Ni_{10}Cu_{17.5}$ | 1,480 | 2,770 | 0.9 | 92 | 430 | 630 | 736 |
| $Zr_{60}Al_{15}Co_{2.5}Ni_{7.5}Cu_{15}$ | 1,590 | 2,970 | 1.0 | 91 | 460 | 652 | 768 |

It is clearly noted from the table that the produced amorphous alloy materials showed such magnitudes of bending strength as notably surpass the magnitude (about 1,000 MPa) of the partially stabilized zirconia heretofore adopted as the material for a formed ceramic article, such magnitudes of Young's modulus as approximate one half, and such magnitudes of hardness as approximate one third thereof, indicating that these alloy materials were vested with properties necessary as the material for various formed articles.

According to the present invention, as described above, a formed article of amorphous alloy satisfying a predetermined shape, dimensional accuracy, and surface quality despite complexity or delicateness of shape can be manufactured with high productivity at a low cost owing to the combined use of a technique based on the metal mold casting process with the amorphous alloys exhibiting a glass transition region. Further, since the amorphous alloy to be used for the present invention excels in strength, toughness, and resistance to corrosion, various precision formed articles manufactured from this amorphous alloy withstand long service without readily sustaining abrasion, deformation, chipping, or other similar defects.

While certain specific embodiments have been disclosed herein, the invention may be embodied in other specific forms without departing from the spirit or essential characteristics thereof. The described embodiments are therefore to be considered in all respects as illustrative and not restrictive, the scope of the invention being indicated by the appended claims rather than by the foregoing description and all changes which come within the meaning and range of equivalency of the claims are, therefore, intended to be embraced therein.

What is claimed is:

1. An apparatus for the production of a formed article of amorphous alloy, comprising:

a forced cooling casting mold which is provided in the lower part thereof with a sprue and in the inner part thereof with at least one molding cavity communicating with said sprue through the medium of a runner and further provided with a cutting member disposed in said casting mold movably in the direction of said sprue and a closing member which is movable perpendicular to the direction of movement of said cutting member and disposed between said cutting member and said runner; and a melting vessel disposed under said casting mold movably in the direction of said sprue, said melting vessel being provided with a raw material accommodating hole having an upper open end and a molten metal transferring member disposed slidably in said raw material accommodating hole.

2. The apparatus according to claim 1, wherein either or both of said closing member and a peripheral wall portion of said sprue is made of an insulating material.

3. The apparatus according to claim 1, wherein said forced cooling casting mold and said melting vessel are disposed in a chamber which is evacuated or into which an inert gas is introduced.

4. The apparatus according to claim 1, further comprising a hydraulic or a pneumatic cylinder for actuating said molten metal transferring member.

5. The apparatus according to claim 1, wherein said forced cooling casting mold is a split mold.

6. The apparatus according to claim 1, wherein said forced cooling casting mold is a water-cooled casting mold or gas-cooled casting mold.

7. The apparatus according to claim 1, wherein said melting vessel is provided with a high-frequency induction coil or a resistance heater.

8. An apparatus for the production of a formed article of amorphous alloy, comprising:

a vertically movable melting vessel having a lower open end; and a forced cooling casting mode disposed under said melting vessel, said casting mold being provided with a closable sprue and at least one molding cavity adapted to establish, on closely contacting the lower part of said melting vessel, communication with said sprue through the medium of a runner and further with a molten metal transferring member disposed slidably in said molding cavity, a cutting member disposed in said casting mold movably in the direction of said sprue and a closing member which is movable perpendicular to the direction of movement of said cutting member and disposed between said cutting member and said runner.

9. The apparatus according to claim 8, wherein either or both of said closing member and a peripheral wall portion of said sprue is made of an insulating material.

10. The apparatus according to claim 8, further comprising a closing member disposed in the lower end part of the sprue in such a manner as to be slidably moved in a direction perpendicular to the direction of movement of the cutting member.

11. The apparatus according to claim 8, wherein said forced cooling casting mold and said melting vessel are disposed in a chamber which is evacuated or into which an inert gas is introduced.

12. The apparatus according to claim 8, further comprising a hydraulic or a pneumatic cylinder for actuating said molten metal transferring member.

13. The apparatus according to claim 8, wherein said forced cooling casting mold is a split mold.

14. The apparatus according to claim 8, wherein said forced cooling casting mold is a water-cooled casting mold or gas-cooled casting mold.

15. The apparatus according to claim 8, wherein said melting vessel is provided with a high-frequency induction coil or a resistance heater.

* * * * *